US011019886B2

(12) United States Patent
Hayashi et al.

(10) Patent No.: US 11,019,886 B2
(45) Date of Patent: Jun. 1, 2021

(54) BUTTON

(71) Applicant: YKK CORPORATION, Tokyo (JP)

(72) Inventors: Daisuke Hayashi, Tokyo (JP); Hayuru Tanaka, Tokyo (JP); Kota Kanno, Tokyo (JP); Ryohei Nakawatase, Tokyo (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 16/621,171

(22) PCT Filed: Jun. 12, 2017

(86) PCT No.: PCT/JP2017/021669
§ 371 (c)(1),
(2) Date: Dec. 10, 2019

(87) PCT Pub. No.: WO2018/229835
PCT Pub. Date: Dec. 20, 2018

(65) Prior Publication Data

US 2020/0128921 A1 Apr. 30, 2020

(51) Int. Cl.
*A44B 1/34* (2006.01)

(52) U.S. Cl.
CPC ..... *A44B 1/34* (2013.01)

(58) Field of Classification Search
CPC ..... A44B 1/34; A44B 17/00; A44B 17/0023; A44B 17/0029; A44B 17/0035;
(Continued)

(56) References Cited

U.S. PATENT DOCUMENTS 4,982,480 A * 1/1991 Kasai ..... A44B 17/0029 24/104
5,933,929 A * 8/1999 Kawakami ..... A44B 17/0035 24/324
(Continued)

FOREIGN PATENT DOCUMENTS

JP S57-040306 U 3/1982
JP S60-083313 U 6/1985
(Continued)

OTHER PUBLICATIONS

International Search Report for related International Application No. PCT/JP2017/021669, dated Aug. 15, 2017; English translation of ISR provided (4 pages).
(Continued)

*Primary Examiner* — Robert Sandy
(74) *Attorney, Agent, or Firm* — Procopio, Cory, Hargreaves & Savitch LLP

(57) ABSTRACT

Provided is an injection-molded resin button, which does not crack or is unlikely to crack at attaching the button to a fabric. This invention relates to a button including a button body having a through-hole at the center thereof. The button body of the button includes a left half part and a right half part, which are segmented left and right by a virtual straight line passing through a gate position, on the button body, corresponding to a gate of a mold for molding the button and the center of the button body. The button body includes one or more concave portions or one or more convex portions on an outer surface of the button body. The button is characterized in that the concave portions or the convex portions are provided asymmetrically in the left and right half parts. The button body includes a nonlinear weld line at least on the outer surface.

11 Claims, 12 Drawing Sheets

(58) Field of Classification Search
CPC ..... A44B 17/0041; Y10T 24/3698; Y10T 24/3611; Y10T 24/3613; Y10T 24/3615; A44D 2201/04; A44D 2201/06; A44D 2201/50
See application file for complete search history.

(56) References Cited

U.S. PATENT DOCUMENTS

| | | | | |
|---|---|---|---|---|
| 6,757,945 | B2 * | 7/2004 | Shibuya | A47G 27/0418 16/8 |
| 8,539,652 | B2 * | 9/2013 | Richardson | F16B 21/073 24/603 |
| 9,060,572 | B2 * | 6/2015 | Hasegawa | A44B 17/0041 |
| 9,179,742 | B2 * | 11/2015 | Richardson | F16B 21/073 |

FOREIGN PATENT DOCUMENTS

| | | | |
|---|---|---|---|
| JP | 62256621 | A | 11/1987 |
| JP | 2003-310310 | A | 11/2003 |
| JP | 2007-221870 | A | 8/2007 |

OTHER PUBLICATIONS

International Preliminary Report on Patentability for related PCT App No. PCT/JP2017/021669 dated Dec. 17, 2019, 6 pgs.
Extended European Search Report for related EP App No. 17913656.9 dated Dec. 14, 2020, 7 pgs.

* cited by examiner

【FIG. 1】
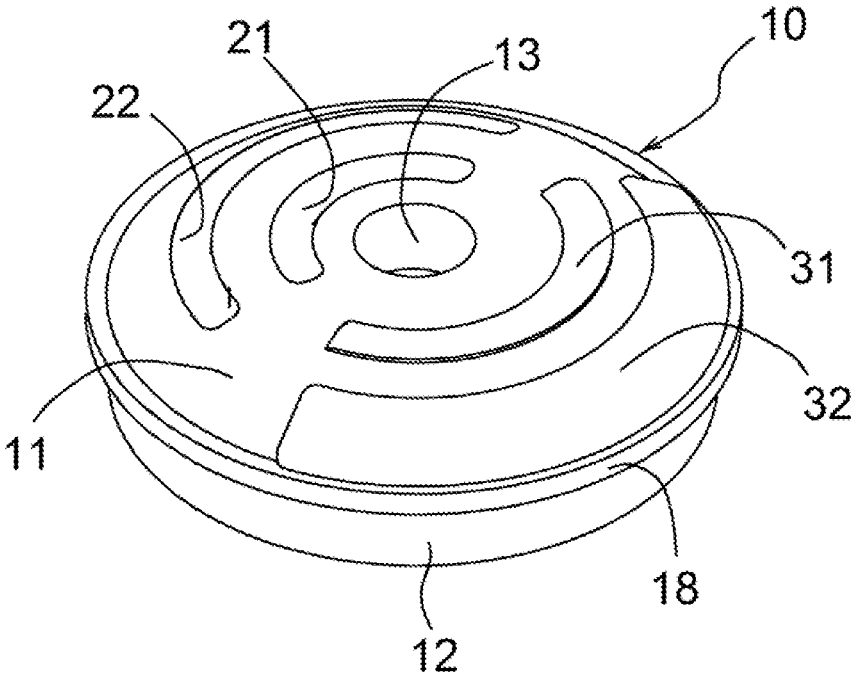

【FIG. 2】
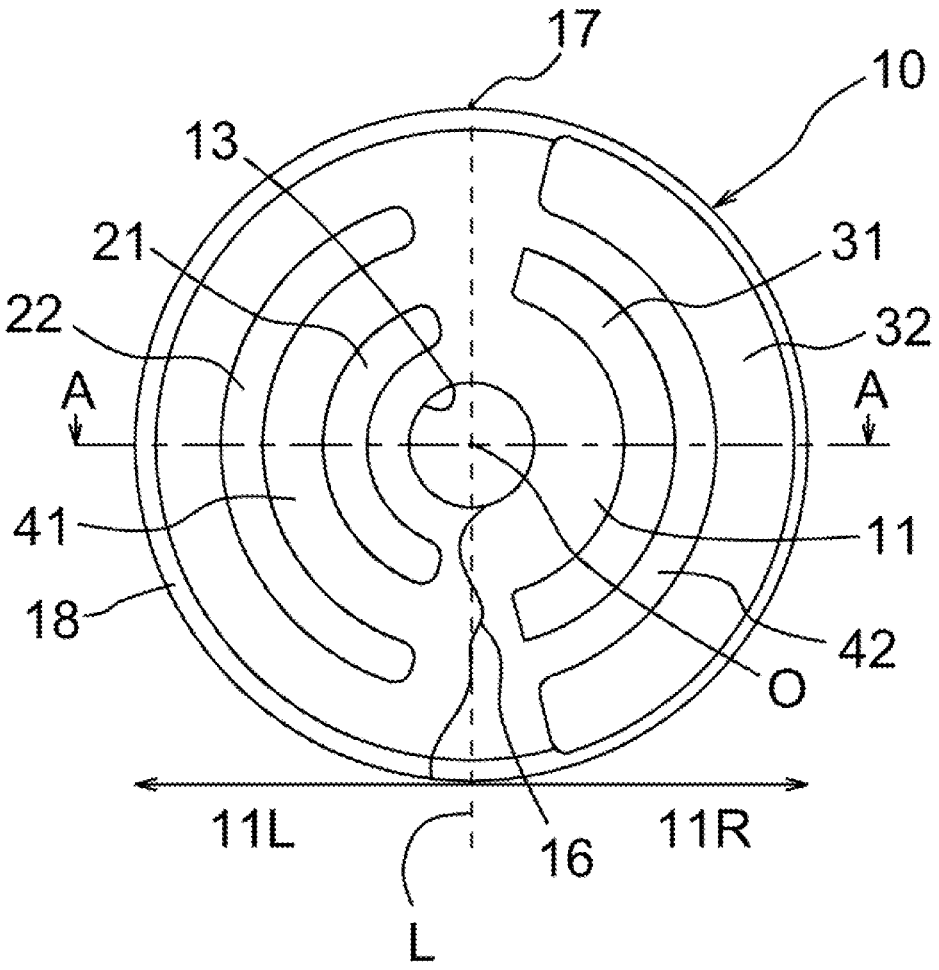

【FIG. 3】
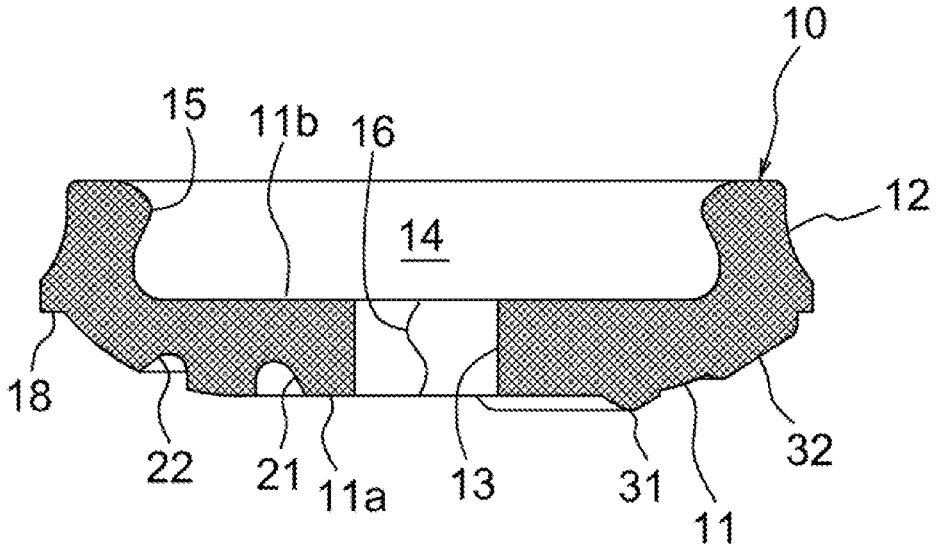

【FIG. 4】
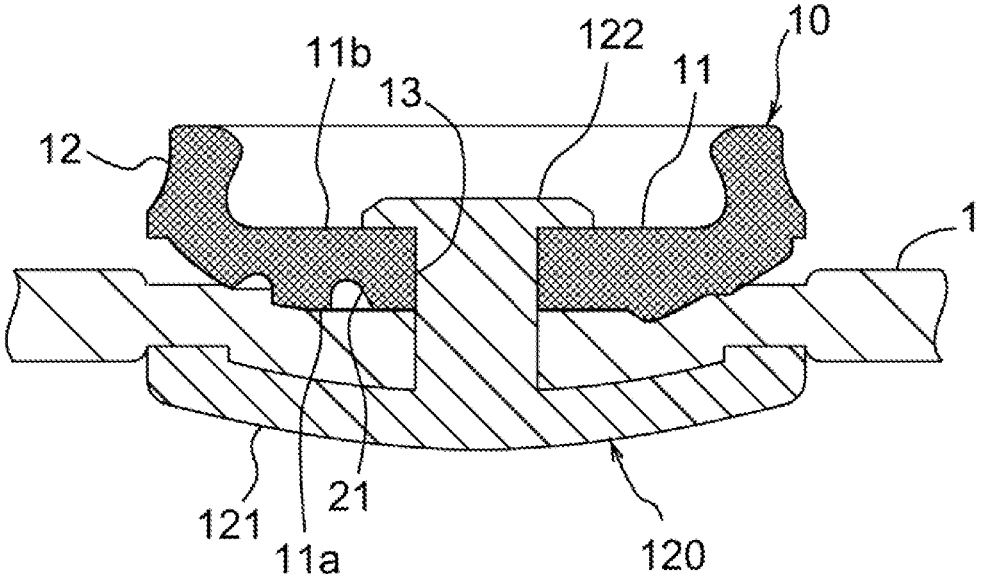

【FIG. 5】
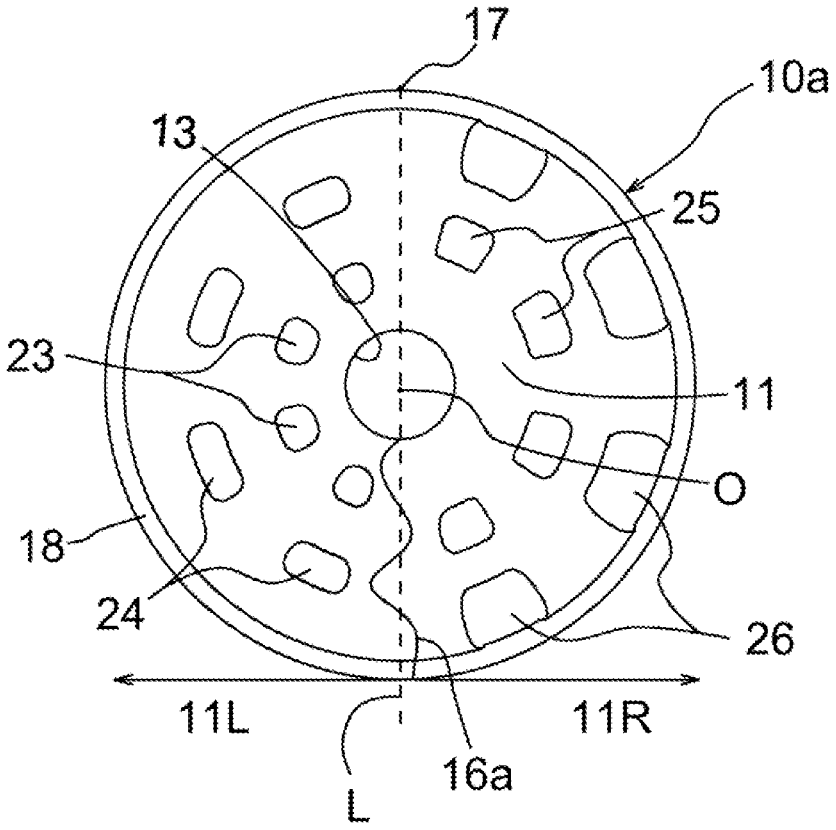

【FIG. 6】
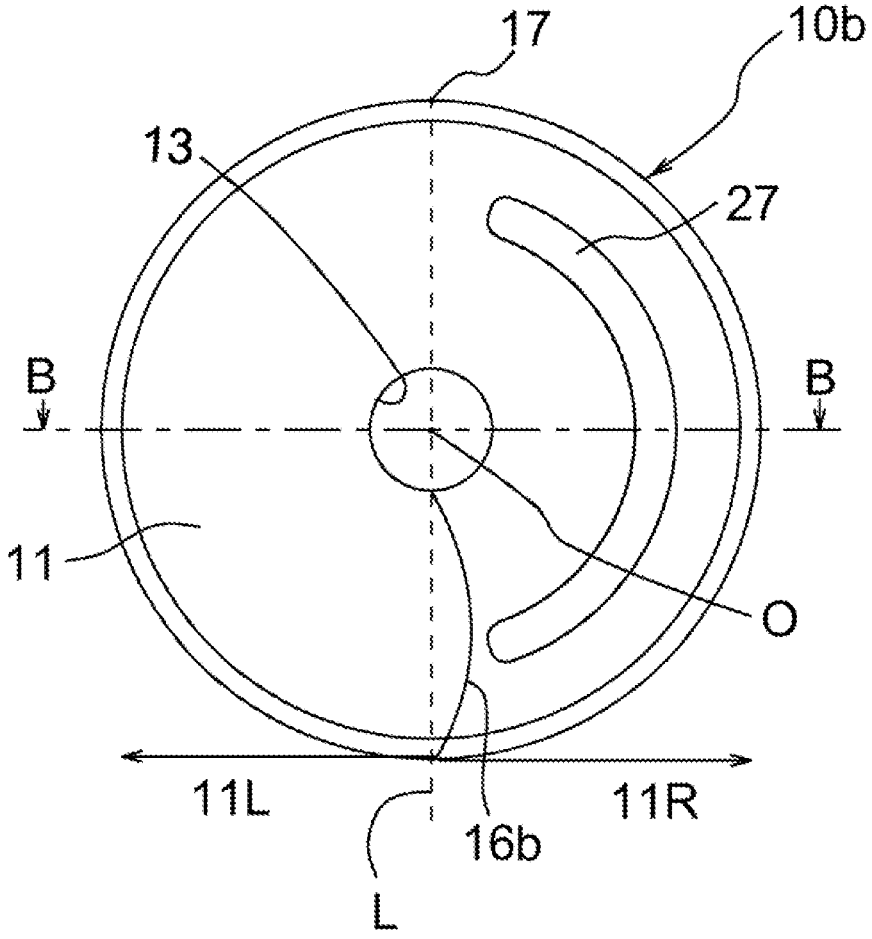

【FIG. 7】
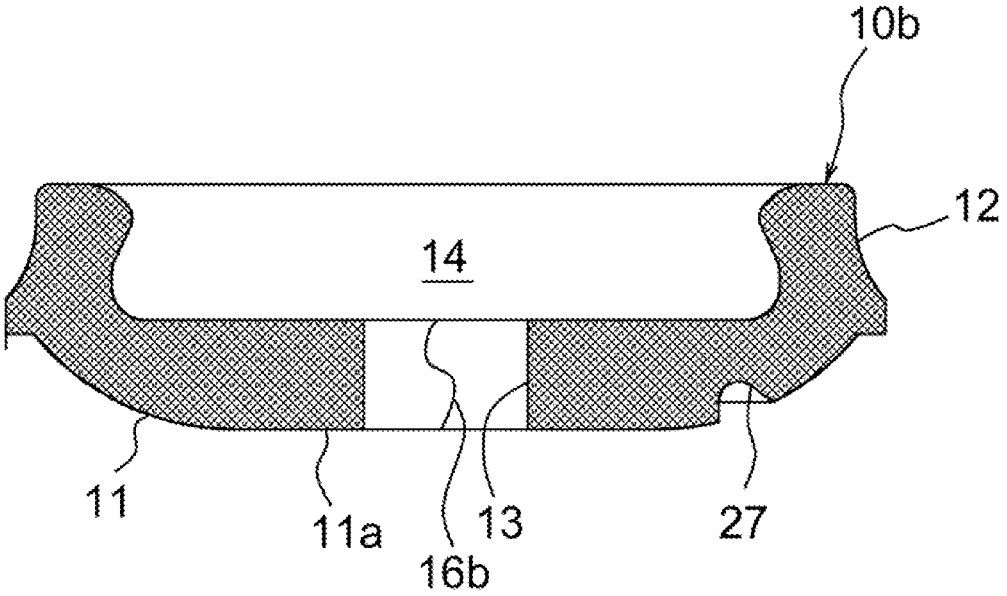

【FIG. 8】
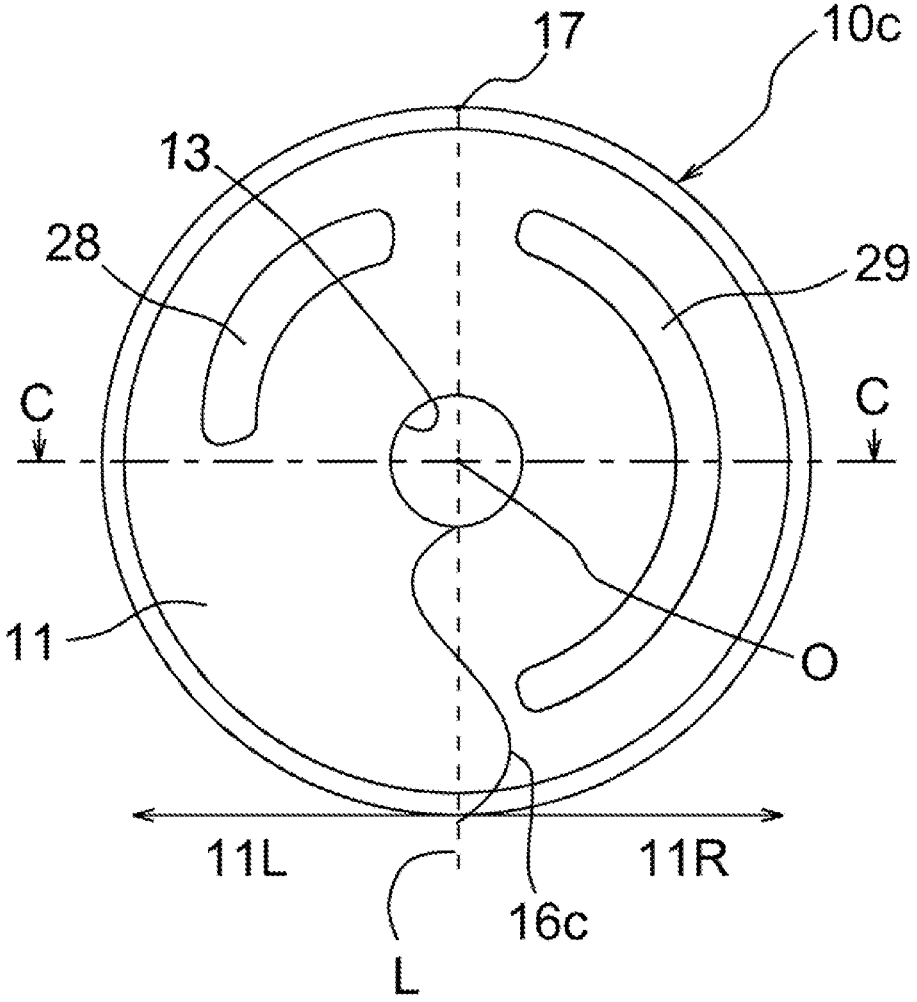

【FIG. 9】
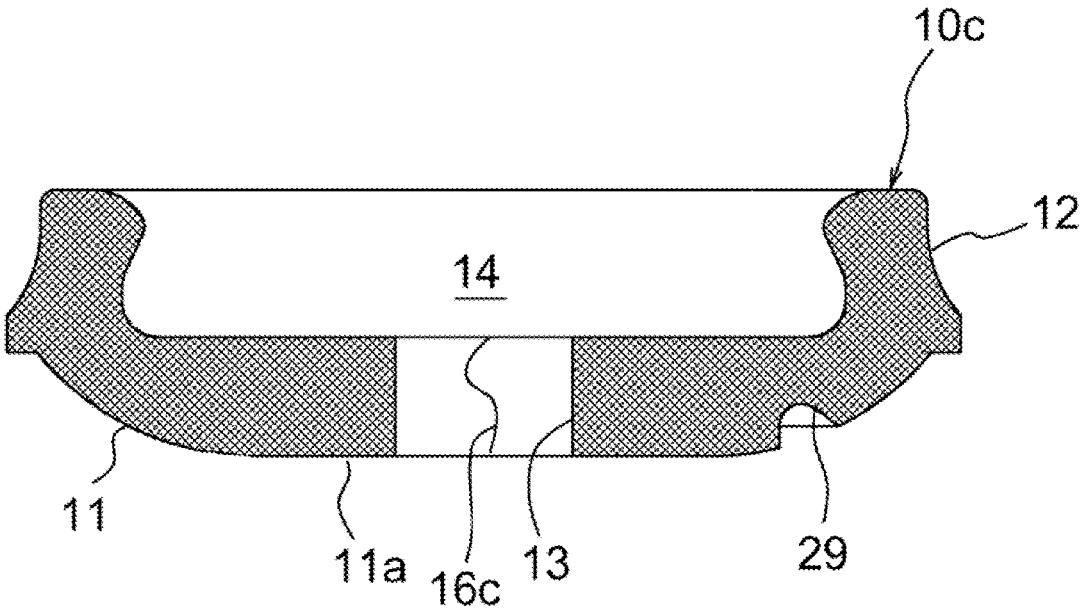

【FIG.10】
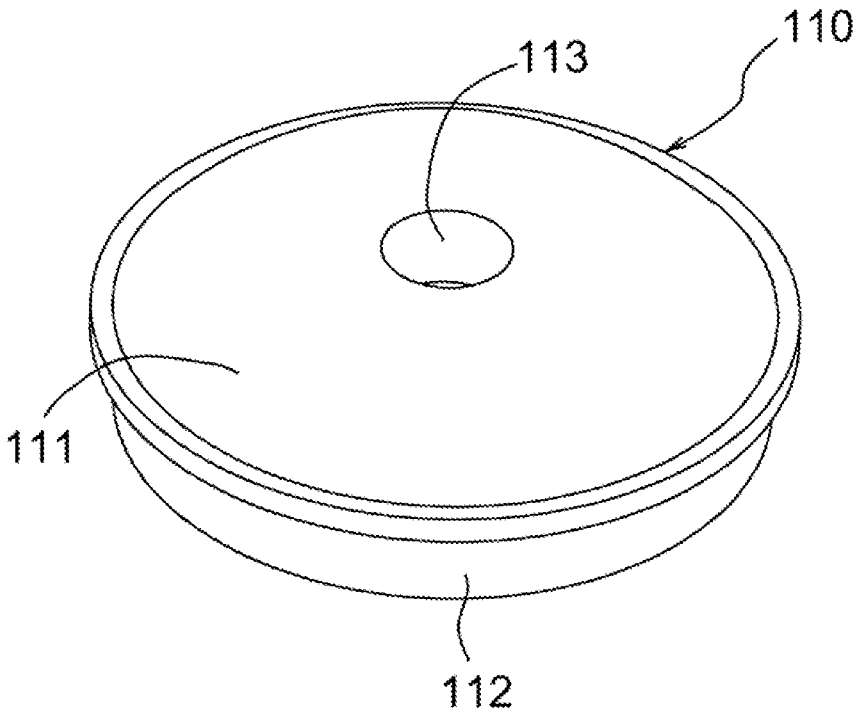
RELATED ART

【FIG.11】
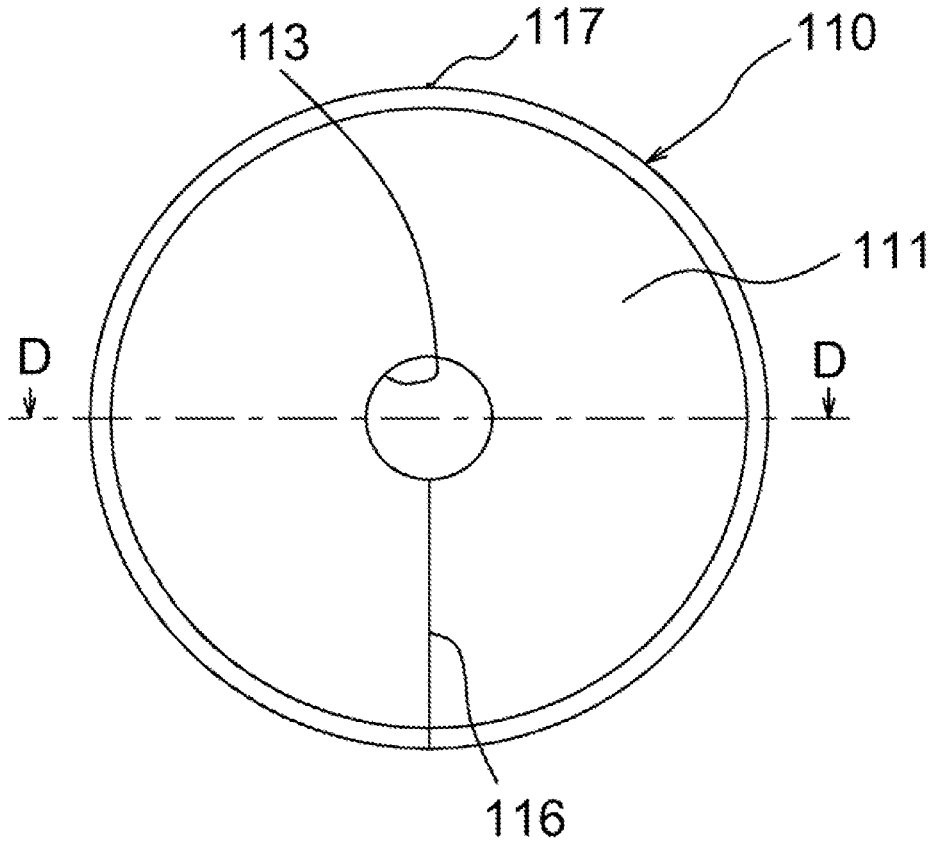
RELATED ART

【FIG.12】
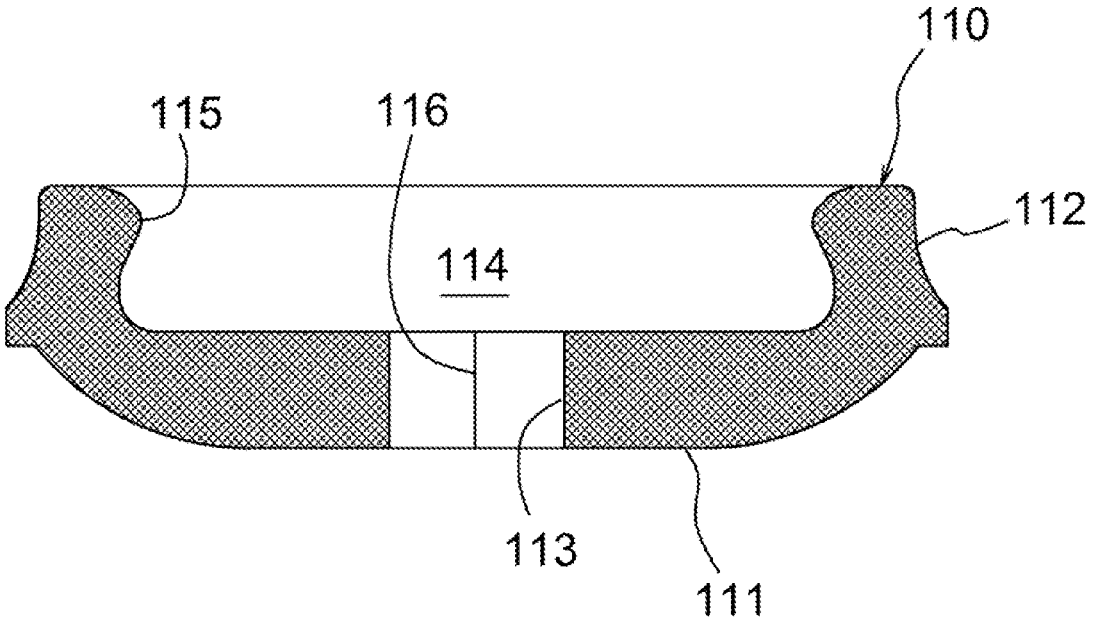
RELATED ART

BUTTON

CROSS-REFERENCE TO RELATED APPLICATIONS

This application is a U.S. National Stage entry of PCT Application No: PCT/JP2017/021669 filed Jun. 12, 2017, the contents of which are incorporated herein by reference.

TECHNICAL FIELD

The present invention relates to a button, especially a button such as an injection molded resin female snap button.

BACKGROUND ART

A synthetic resin female snap button (hereinafter simply referred to as "female snap" in this specification) which is engaged with and disengaged from a male snap button is widely used for clothes, bags, and the like. Such a female snap is described in, for example, JP2003-310310A. FIGS. 10 and 11 are a perspective view and a bottom view of a conventional female snap 110, and FIG. 12 is a sectional view taken along the line D-D in FIG. 11. Hereinafter, an upper or upward side and a lower or downward side are based on FIG. 12, and a vertical (up-and-down) direction corresponds to the thickness direction of the female snap 110 in FIG. 12. The female snap 110 includes a substantially disk-shaped bottom portion 111 and a peripheral side portion 112 that protrudes upward from the radially outer end of the bottom portion 111. In the center of the bottom portion 111, a through-hole 113 is provided for passing a pin 122 of a button fastener 120 (see FIG. 4). A space 114 above the bottom portion 111 and radially inward of the peripheral side portion 112 is a receiving portion 114 which detachably receives an engagement projection of a male snap as not shown. At the upper end on the radially inner surface of the peripheral side portion 112A, a bulge 115 bulging radially inward is provided. The bulge 115 is temporarily bent radially outward when the engagement projection of the male snap is received in and removed from the receiving portion 114.

When the above-mentioned female snap 110 is attached to a fabric such as clothes, the female snap 110 is held on an upper die and the button fastener 120 is set on a lower die of the button attachment machine with the fabric 1 (see FIG. 4) being placed between the female snap 110 and the button fastener 120. Then, the upper die is lowered toward the lower die. Thereby, the pin 122 of the button fastener 120 penetrates the fabric 1 upward to pass through the through-hole 113 of the female snap 110. After that, the pin 122 is swaged on the bottom portion 111 of the female snap 110 by a punch of the upper die (See FIG. 4). Thereby, the female snap 110 is fixed to the fabric.

CITATION LIST

Patent Literatures

JP2003-310310A

SUMMARY OF INVENTION

Technical Problem

In the conventional injection-molded female snap 110 made of synthetic resin, there is a case where the bottom portion 111 of the female snap 110 cracks when the pin 122 of the button fastener 120 passes through the through-hole 113 of the female snap 110 at attaching the female snap 110 to the fabric 1. The inventors have carefully observed the phenomenon that the female snap 110 cracks, and found out the following. The female snap 110 is molded by injecting a molten resin material into a cavity of a mold from an injection port called a gate at a side of the cavity. In the center of the cavity, there is a core (pin) for forming the through-hole 113. The resin material injected through the gate is once divided into left and right flows by the core, and the flows meet and join again behind the core. The spot where the resin flows joined will appear as a weld line 116 on the outer and inner surfaces and the peripheral surface defining the through-hole 113 of the bottom portion 111 of the female snap 110 as a molded product. FIGS. 11, 12 shows respectively the weld line 116 appearing on the outer surface of the bottom portion 111 and on the peripheral surface defining the through-hole 113. Further, at a location corresponding to the gate in the female snap 110, a trace of the gate position 117 (see FIG. 11) remains slightly. The weld line 116 in a conventional product appears as a straight line substantially along a virtual straight line passing through the gate position 11 and the center of the female snap 110. The weld line 116 is also linear in the thickness direction (vertical direction) of the bottom portion 111 and appears as a straight weld line 116 (see FIG. 12) along the vertical direction on the peripheral surface defining the through-hole 113. Although not shown, the weld line 116 appears as a straight line along the vertical direction on a cross section parallel to the cross section of FIG. 12. The weld line 116, which is a material merging spot, is a low strength portion in the bottom portion 111 of the female snap 110. Therefore, when the pin 122 of the button fastener 120 comes into the through-hole 113 along with a portion of the fabric 1 being pulled by the pin 122 at attaching the female snap 110 to the fabric 1, the bottom portion 111 receives a force to radially expand the through-hole 113 by the portion of the fabric 1 pulled by the pin 122. Such a force is considered to be the cause of cracking along the linear weld line 116.

The present invention has been made in view of the above problem, and an object of the present invention is to provide an injection-molded resin button, which does not crack or is unlikely to crack at attaching the button to a fabric.

Solution to Problem

In order to solve the above-mentioned problems, according to the present invention, there is an injection-molded resin button comprising a button body having a through-hole at the center thereof: wherein the button body comprises a left half part and a right half part, the left and right half parts being segmented left and right by a virtual straight line passing through a gate position, on the button body, corresponding to a gate of a mold for molding the button and the center of the button body, wherein the button body includes one or more concave portions or one or more convex portions on an outer surface of the button body, the concave portions or the convex portions being provided asymmetrically in the left and right half parts. The above "outer surface" means a surface of the button body which will come into contact with a fabric when the button is attached to the fabric. The outer surface corresponds to a lower surface of a bottom portion 11 represented by reference numeral 11*a* in FIG. 3. Further, left and right arc concave portions or left and right arc convex portions and first and second arc concave portions or arc convex portions as described below are examples of the concave portions or the convex portions.

In one embodiment of the present invention, the button body includes a weld line, and wherein the weld line appears as a nonlinear line at least on the outer surface of the button body. In another embodiment of the present invention, the weld line appears as a nonlinear line on an inner surface of the button body. In still another embodiment, the weld line appears as a nonlinear line on a peripheral surface defining the through-hole of the button body. Further, in one embodiment of the present invention, the weld line appearing on the outer surface of the button body is at least partially zigzag.

In the present invention, one or more concave or convex portions are provided on the outer surface of the button body asymmetrically in the left half part and the right half part of the button body which are segmented left and right by the virtual straight line connecting the gate position (a gate trace, which slightly remains on a peripheral side surface of the button body and which corresponds to a gate of a mold for molding the button) of the button body and the center. Such concave or convex portions are molded by convex or concave portions on a cavity surface of the mold. A melted resin material injected through the gate is once divided into left and right resin flows by a core that is at the center of the cavity for molding the through-hole. In other words, the material is divided into a left half space and a right half space of the cavity which are segmented by a virtual straight line passing through the gate and the center of the cavity (or the core). These left and right flows join again behind the core. Resistances to the left and right divided flows or velocities thereof are different in the left and right half spaces of the cavity, because the convex or concave portions on the cavity are provided asymmetrically in the right and left spaces of the cavity. Thereby, a weld line as a spot where the right and left flows meet and join will not be linear along the virtual straight line unlike before. Therefore, a nonlinear weld line (see reference numeral 16 in FIG. 2, etc.) appears on exposed surfaces including the outer surface of the button body. The weld line is also nonlinear in the thickness direction (the vertical direction based on FIG. 3) of the button body (see reference numeral 16 in FIG. 3, etc.). Thereby, the length of the weld line on outer or inner surfaces, etc. of the button body will be longer than that of the weld line 116 in the conventional product. Therefore, the area of a spot on which the left and right resin flows join increases, enhancing joining strength of the flows. Thereby, it will be possible to eliminate or reduce cracking of the button body along the weld line when the button is attached to the fabric. Concave or convex portions provided in the left and right half parts of the button body are not limited in number, shape, arrangement, etc. as long as they are bilaterally asymmetrical. However, it is preferable to form concave or convex portions so as to make the weld line zigzag. Thereby, even if the button body receives a force to radially expand the through-hole by a portion of a fabric pulled by a pin of a button fastener when the button is attached to the fabric, it is possible to reduce an effect of cracking along the weld line.

In one embodiment of the present invention, the left half part and the right half part are different in volume. The left half part and the right half part can have the same volume as long as the number, shape, arrangement, etc. of the concave or convex portions are asymmetrical right and left. However, it is possible to help increase the length of the weld line by making the concave or convex portions different in volume between the left and right half parts. The difference in volume in the left and right half parts can be determine by measuring the weight each of the left and right half parts of a button, which are split along the above-mentioned virtual straight line connecting the gate position and the center. That is, if the left and right half parts are equal in weight, their volumes are equal, and if the left and right half parts are different in weight, heavier part is large and lighter part is small in volume.

In one embodiment of the present invention, the left half part includes one or more left arc concave portions or left arc convex portions extending or arranged in an arc shape in the circumferential direction around the center, wherein the right half part includes one or more right arc concave portions or right arc convex portions extending or arranged in an arc shape in the circumferential direction, and wherein the left arc concave portions or left arc convex portions and the right arc concave portions or right arc convex portions are displaced from each other in the radial direction. Since the left arc concave portions (or convex portions) and the right arc concave portions (or convex portions) are radially displaced from each other, a joining spot of the left and right resin flows divided at molding varies leftward and rightward in the radial direction. Thereby, a weld line becomes zigzag, making the weld line longer.

In one embodiment of the present invention, the left half part includes one or more left arc concave portions or left arc convex portions extending or arranged in an arc shape in the circumferential direction around the center, wherein the right half part includes one or more right arc concave portions or right arc convex portions extending or arranged in an arc shape in the circumferential direction, and wherein the left arc concave portions or left arc convex portions and the right arc concave portions or right arc convex portions are at the same location in the radial direction and different in length in the circumferential direction. In a case where the left and right arc concave (or convex) portions are different in circumferential length even though they are at the same radial location, a joining spot of the left and right resin flows divided at molding will be easy to vary leftward and rightward in the radial direction. Thereby, the joining spot varies left and right relative to the virtual straight line as the center line at the same radial location where the left and right arc concave (or convex) portions lie, making the weld line longer.

In one embodiment of the present invention, the left half part or the right half part includes one or more first arc concave portions or first arc convex portions extending or arranged in an arc shape in the circumferential direction around the center, and one or more second arc concave portions or second arc convex portions extending or arranged in an arc shape in the circumferential direction, the second arc concave portions or second arc convex portions being provided with an interval in the radial direction relative to the first arc concave portions or first arc convex portions. In this way, by providing the first arc concave portions (or convex portions) and the second arc concave portions (or convex portions) with an interval between them in the radial direction in the left or right half parts, it is possible to change a resistance or a velocity, in the radial direction, of one flow (one the side where the first and second arc concave (or convex) portions and the interval to be formed) of the left and right resin flows divided at molding relative to the other flow. Thereby, it is possible to vary, left and right in the radial direction, a spot where the one and other flows join. Thereby, the weld line is easy to be zigzag, making the weld line longer.

In one embodiment of the present invention, only one of the left half part and the right half part includes one or more concave portions or convex portions on the out surface. Thereby, it is possible to displace, relative to the virtual straight line, a joining spot of the left and right resin flows divided at molding, making the weld line longer.

In one embodiment of the present invention, the button is a female snap button, wherein the button body is a bottom portion of the female snap button, and wherein the female snap button includes a peripheral side portion protruding from a radially outer end of the bottom portion.

Examples of a resin of which the button in the present invention is made include thermosetting resins such as phenol resin (PF), epoxy resin (EP), melamine resin (MF), urea resin (UF), unsaturated polyester resin (UP), alkyd resin, polyurethane (PUR), thermosetting polyimide (PI), polyethylene (PE); thermoplastic resins such as polypropylene (PP), polyvinyl chloride (PVC), polystyrene (PS), polyvinyl acetate (PVAc), polyurethane (PUR), polytetrafluoroethylene (PTFE), ABS resin (acrylonitrile butadiene styrene resin), AS resin, acrylic resin (PMMA); and the like, but not limited thereto.

Advantageous Effect of Invention

In the present invention, concave portions or convex portions on the outer surface of the button body are provided asymmetrically in the left part and the right part. Thereby, a weld line becomes nonlinear. The weld line is generated as follows. At molding, a melted resin material injected into a cavity through a gate of a mold at molding is once divided into left and right resin flows by a core at the center of the cavity, and the left and right divided resin meet and join behind the core, resulting in the nonlinear weld line. Thereby, the length of the weld line will be longer than that in a conventional product. Further, since the area of the joining spot of the left and right resin flows increases, enhancing joining strength of the flows. Thereby, it will be possible to eliminate or reduce cracking of the button body along the weld line when the button is attached to the fabric.

BRIEF DESCRIPTION OF DRAWINGS

FIG. 1 is a perspective view of a female snap according to a first embodiment of the present invention.

FIG. 2 is a bottom view of the female snap of FIG. 1;

FIG. 3 is a cross-sectional view taken along the line A-A in FIG.

FIG. 4 is a cross-sectional view showing a state in which a female snap is attached to a fabric by a button fastener.

FIG. 5 is a bottom view of a female snap according to a second embodiment of the present invention.

FIG. 6 is a bottom view of a female snap according to a third embodiment of the present invention.

FIG. 7 is a cross-sectional view taken along the line B-B in FIG. 6.

FIG. 8 is a bottom view of a female snap according to a fourth embodiment of the present invention.

FIG. 9 is a cross-sectional view taken along the line C-C in FIG. 8.

FIG. 10 is a perspective view of a conventional female snap.

FIG. 11 is a bottom view of the female snap in FIG. 10;

FIG. 12 is a cross-sectional view taken along the line D-D of FIG. 11.

DESCRIPTION OF EMBODIMENT

Hereinafter, some embodiments of the present invention will be described with reference to the drawings. However, the invention is not limited to the embodiments, and those skilled in the art can suitably modify or alter them within the scope of the claims or the range of equivalents. FIGS. 1 and 2 are a perspective view and a bottom view of a female snap 10 as a button according to an embodiment of the present invention. FIG. 3 is a cross-sectional view taken along the line A-A in FIG. 2. Hereinafter, an upper or upward side and a lower or downward side are based on FIG. 3, and a vertical (up-and-down) direction is the thickness direction of the female snap button of FIG. 3. The female snap 10 is an injection-molded product made of synthetic resin, and includes a substantially disc-shaped bottom portion 11 as a button body and a peripheral side portion 12 that protrudes upward from a radially outer end of the bottom portion 11. In the center of the bottom portion 11, a through-hole 13 is provided for allowing the pin 122 of the button fastener 120 to pass when the female snap 10 is attached to a fabric 1 (see FIG. 4). A space 14 above the bottom portion 11 and radially inward of the peripheral side portion 12 of the female snap 10 is a receiving portion 14 that detachably receives an engagement projection of a male snap as not shown. At an upper end on the radially inner surface of the peripheral side portion 12, a bulge 15 bulging radially inward is provided. The bulge 15 is temporarily bent radially outward when the engagement projection of the male snap is received in and removed from the receiving portion 14. The reference numeral 18 in FIGS. 1 to 3 represents an annular edge 18, which slightly protrudes radially outward and is provided at the boundary with the bottom portion 11 on the radially outer side surface of the peripheral side portion 12. The lower surface (the outer surface in the claims) 11*a* of the bottom portion 11 gradually lowers radially inward from the annular edge 18 and then becomes horizontal. Thus, it can be said that the lower surface 11*a* of the bottom portion 11 is slightly convex downward.

On the lower surface 11*a*, the upper surface 11*b* and the peripheral surface defining the through-hole 13 of the bottom portion 11 of the female snap 10, a nonlinear weld line 16 (see FIGS. 2 and 3) emerges. Further, on the peripheral side portion 12, a trace of the location corresponding to a gate (injection port) of a mold used for molding the female snap 10 slightly remains, and this is a gate position 17. The gate position 17 is located at the top in FIG. 2. The bottom portion 11 of the female snap 10 is virtually segmented into a left half part 11L and a right half part 11R by a virtual straight line L connecting the gate position 17 and the center O of the female snap 10. In the present embodiment, the weld line 16 on the lower surface 11*a* of the bottom portion 11 extends radially outward from the through-hole 13 to the radially outer end of the bottom portion 11 as follows. Firstly, in the radially inward end on the through-hole 13 side, the weld line 16 begins in the right half part 11R and goes into the left half part 11L across the virtual straight line L and then goes back from the left half part 11L to the right half part 11R across the virtual straight line L. After the weld line 16 extends in the above-mentioned zigzag shape, the weld line 16 further extends radially outward almost along the virtual straight line L. After this, the weld line 16 goes into the left half part 11L and then terminates at the radially outer end. The weld line 16 is also nonlinear in the vertical direction of the bottom portion 11, and the vertically zigzag weld line 16 appearing on the peripheral surface defining the through-hole 13 is shown in FIG. 3. Although not shown, the weld line 16 appearing on the upper surface 11*b* of the bottom portion 11 is different in shape from the weld line 16 appearing on the lower surface 11*a*.

In the left half part 11L of the bottom portion 11, a first left arc concave portion 21 and a second left arc concave portion 22 are formed. The first and second left arc concave portions 21, 22 extend in an arc shape in the circumferential direction around the center O, and the second left arc concave portion 22 are located radially outward from the first left arc concave portion 21 with an interval 41. In this embodiment, the width along the radial direction of each of the first and second left arc concave portions 21, 22 is the same, and the degree of depression from the lower surface 11*a* of each of the first and second left arc concave portions 21, 22 is also almost the same. In the right half part 11R of the bottom portion 11, a first right arc convex portion 31 and a second right arc convex portion 32 are formed. The first and second right arc convex portions 31, 32 extend in an arc shape in the circumferential direction, and the second right arc convex portion 32 are located radially outward from the first right arc convex portion 31 with an interval 42. The first and second left arc concave portions 21, 22 and the first and second right arc convex portions 31, 32 extend about 170 degrees in the circumferential direction. In this embodiment, the width along the radial direction of the second right arc convex portion 32 is about twice the width along the radial direction of the first right arc convex portion 31. Further, the degree of protrusion from the lower surface 11*a* of each of the first and second right arc convex portions 31, 32 is almost the same. Further, the first right arc convex portion 31 is located, in the radial direction, between the first and second left arc concave portions 21, 22. In other words, the first right circular arc convex portion 31 is displaced in the radial direction from the first and second left arc concave portions 21, 22. The second right arc convex portion 32 is formed radially outside the second left arc concave portion 21. As described above, in the left and right half parts 11 L, 11R of the bottom portion 11 of the female snap 10, the first and second left arc concave portions 21, 22 as concave portions and the first and second right arc convex portions 31, 32 as convex portions are provided bilaterally asymmetrically. In this embodiment, the volume of the left half part 11L including the first and second left arc concave portions 21, 22 is smaller than the volume of the right half part 11R including the first and second right arc convex portions 31, 32.

As in the above example, the weld line 16, which is generated by left and right resin flows joined at molding the female snap 10, can be extended in a zigzag shape such as by providing the left half part 11L with the concave portions (21, 22) and providing the right half part 11R with the convex portions (31, 32); further displacing the concave and convex portions (21, 22; 31, 32) in the radial direction; changing the radial width of each of the convex portions (31, 32). Furthermore, the first and second left arc concave portions 21, 22 are arranged in the radial direction of the bottom portion 11 with the interval 41 between them, and similarly the first and second right arc convex portions 31, 32 are also radially arranged with the interval 42 between them. This way, providing the intervals 41, 42 also helps to extend the weld line 16 so as to increase leftward and rightward swing in a zigzag shape. In this embodiment, the radial width of the interval 41 of the left half part 11L is larger than radial width of the first right arc convex portion 31, which is arranged at the same radial position as with the interval 41. This is also considered to promote a zigzag extension of the weld line 16. The interval 42 of the right half part 11R has almost the same radial width as that of the second left arc concave portion 22, which is arranged at the same radial position as with the interval 42. In this way, it is preferable that the width in the radial direction each of the intervals 41, 42 is larger than or equal to the radial width of convex or concave portion arranged, in other half part, at the radial position corresponding to the intervals 41, 42.

The first and second left arc concave portions 21, 22 as described above are molded by convex portions provided on a cavity surface of a mold (not shown) for molding the female snap 10, and the first and second right arc convex portions 31, 32 are molded by concave portions on the cavity surface. In this way, since the mold is provided with convex and concave portions bilaterally asymmetrically, the nonlinear weld line 16 shown in FIG. 2, etc. is generated. That is, when the female snap 10 is molded, a melted resin material injected into the cavity through the gate of the mold is once divided into left and right flows by a center core corresponding to the through-hole (the material is divided into a left half part and a right half part of the cavity by a virtual straight line passing through the gate and the center of the cavity (core)). The left and right divided flows meet and join again behind the core. At this time, resistances to the left and right divided flows or velocities thereof are different in the left and right half spaces of the cavity, and therefore the spot where the resign flows joined will not become a linear line, resulting in the weld line 16 that is at least partially zigzag. Thereby, when the female snap 10 is attached to the fabric 1, the bottom portion 11 does not crack or is unlikely to crack along the weld line 16.

FIG. 4 is a cross-sectional view showing a state in which the female snap 10 is attached to the fabric 1 with the button fastener 120. The button fastener 120 comprises a substantially disk-shaped base 121 and a pin 122 protruding from a center area of the base 121. When the female snap 10 is attached to the fabric 1 using the button attachment machine, the pin 122 of the button fastener 120 penetrates the fabric 1 upward and passes through the through-hole 13 of the female snap 10. After this, the pin 122 is swaged as being crushed by a punch as not shown. Thereby, the female snap 10 is fixed to the fabric 1. Since the pin 122 of the button fastener 120 comes into the through-hole 13 of the female snap 10 along with a portion of the fabric 1 being pulled by the pin 122, the bottom portion 11 receives a force to radially expand the through-hole 13. Such a force is considered to be the cause of cracking along the weld line 16 having a relatively low strength. In this embodiment, with the bilaterally-asymmetric convex and concave portions as stated above, it is possible to intentionally extend the weld line 16 in a zigzag shape, the weld line 16 being a spot of joining left and right resin flows. Thereby, strength of the resin-joining spot increases, decreasing or eliminating the above-mentioned cracking. As shown in FIG. 4, the female snap 10 is attached to the fabric 1 so that the lower surface 11*a* of the bottom portion 11 faces the fabric 1. Therefore, concave portions (or convex portions) provided on the lower surface 11*a* of the bottom portion 11 are not seen by a user after the female snap 10 is attached to the fabric 1. On the other hand, the upper surface 11*b* of the bottom portion 11 is visible to a user even after being attached to the fabric 1. Therefore, it is possible to form concave portions (or convex portions) on the lower surface 11*a* of the bottom portion 11 without considering aesthetic appearances when the arbitrary, nonlinear weld line 16 is formed.

FIG. 5 is a bottom view showing a female snap 10*a* as a button according to a second embodiment of the present invention. Since the female snap 10*a* is common to the female snap 10 except for concave portions 23, 24, 25, 26 as described below, same reference numerals as with the female snap 10 are used except for the concave portions 23, 24, 25, 26 and descriptions thereof are omitted. The female snap 10*a* is provided with concave portions on the lower surface 11*a* of the bottom portion 11 as follows. The left half part 11L of the bottom portion 11 includes four first left concave portions (one left arc concave portion) 23 arranged in an arc shape in the circumferential direction around the center O, and four second left concave portions (one left arc concave portion) 24 arranged radially outward from the first left concave portions 23 with an interval and in a circumferentially arc shape. Each of the first left concave portions 23 has a square or trapezoidal shape with rounded corners. Each of the second left concave portions 24 has a square shape with rounded corners, and is approximately twice as large as each of the first left concave portions 23. Further, the right half part 11R of the bottom portion 11 includes four first right concave portions (one right arc concave portion) 25 arranged in an arc shape in the circumferential direction, and four second right concave portions (one right arc concave portion) 26 arranged radially outward from the first right concave portions 25 with an interval and in a circumferentially arc shape. Each of the first right concave portions 25 has a square shape with rounded corners. Each of the second right concave portion 26 has a square or trapezoidal shape with rounded corners, and is approximately twice as large as each of the first right concave portions 25. Further, the first right concave portions 25 are provided, in the radial direction, between the first and second left concave portions 23, 24, and the second right concave portions 26 are provided radially outward from the second left concave portions 24. Furthermore, each of the first right concave portions 25 is larger than each of the first left concave portions 23, and each of the second right concave portions 26 is larger than each of the second left concave portions 24. In the female snap 10*a*, the volume of the left half part 11L is larger than that of the right half part 11R. The female snap 10*a* is molded by a mold, which includes a cavity having convex portions corresponding to the concave portions 23, 24, 25, 26. On the lower surface 11*a* of the bottom portion 11 of the female snap 10*a*, a zigzag weld line 16*a* shown in FIG. 5 is generated. The radially inner end of the weld line 16*a* is located on the virtual straight line L. The weld line 16*a* goes radially outward into the left half part 11L from the radially inner end; then returns rightward going into the right half part 11R across the virtual straight line L; then returns leftward going into the left half part 11L across the virtual straight line L again; then returns rightward again going into the right half part 11R across the virtual straight line L; and extends to and terminates at the radially outer end. In the female snap 10*a*, the bottom portion 11 hardly cracks along the weld line 16*a* when the female snap 10*a* is attached to the fabric.

Further, in the female snap 10*a* of the second embodiment, there are three flat portions between two of the four first left concave portions 23 formed in the left half part 11L of the bottom portion 11*a*. These flat portions are not concave or convex and define the lower surface 11*a* of the bottom portion 11. It can be said that each of the flat portions is a spot in which more resin material gathered than in each of the first left concave portions 23. That is, in a circumferentially arc shaped region where the four first left concave portions 23 are provided, the portions (flat portions) having more resin are also arranged in an arc shape along the circumferential direction. Similarly, as to the second left concave portions 24 and the first and second right concave portions 25, 26, the portions (flat portions) each having more resin material than each corresponding concave portion are formed and arranged in a circumferentially arc shape between two of the respective second left, first and second right concave portions 24, 25, 26. In this way, in the bottom portion 11, portions (flat portions) having more resin material than concave portions are arranged in an arc shape in the circumferential direction. Thereby, it is possible to make the weld line 16*a* nonlinear, strengthening the female snap 10.

FIG. 6 is a bottom view of the female snap 10*b* according to the third embodiment of the present invention. FIG. 7 is a cross-sectional view taken along the line B-B in FIG. 6. Regarding part of the female snap 10*b* that is common to the female snap 10, same reference numerals as with the female snap 10 are used and descriptions thereof are omitted. The female snap 10*b* includes one concave portion 27 that extends in an arc shape in the circumferential direction in only the right half part 11R on the lower surface 11*a* of the bottom portion 11. The concave portion 27 extends approximately 170 degrees in the circumferential direction. That is, there are no concave and convex portions in the left half part 11L. In this way, by providing the concave portion 27 only in the right half part 11R, the following weld line 16*b* is formed on the lower surface 11*a* of the bottom portion 11 of the female snap 10*b*. That is, referring to FIG. 6, the weld line 16*b* extends radially outward from a left-right intermediate point on the through-hole 13 side almost on the virtual straight line L and gradually goes into the right half part 11R. Then, the weld line 16*b* extends radially outward further, gradually turning leftward toward the virtual straight line L from an almost intermediate point in the radial direction, and terminates at the radially outer end of the bottom portion 11 almost on the virtual straight line L. That is, the weld line 16*b* is generated so as to enter the right half part 11R where the concave portion 27 lies. The weld line 16*b* is a curved line not including a zigzag portion and is nonlinear. This weld line 16*b* can also prevent the female snap 10*b* from cracking when it is attached to the fabric 1.

FIG. 8 is a bottom view of the female snap 10*c* according to the fourth embodiment of the present invention, and FIG. 9 is a cross-sectional view taken along the line C-C in FIG. 8. Regarding part of the female snap 10*c* that is common to the female snap 10, same reference numerals as with the female snap 10 are used and descriptions thereof are omitted. The female snap 10*c* includes a left arc concave portion 28 extending in the circumferential direction on the lower surface 11*a* of the left half part 11L of the bottom portion 11 and a right arc concave portion 29 circumferentially extending on the lower surface 11*a* of the right half part 11R. The left arc concave portion 28 circumferentially extends approximately 40 degrees in the upper half of the left half part 11L based on FIG. 8. The right arc concave portion 29 circumferentially extends approximately 170 degrees in the right half part 11R. The circumferential length of the left arc concave portion 28 is approximately half of that of the right arc concave portion 29. The left arc concave portion 28 and the right arc concave portion 29 are at the same position in the radial direction. Further, the radial width of the left arc concave portion 28 is slightly larger than that of the right arc concave portion 29. In this way, by providing the left and right arc concave portions 28, 29 located at the same radial position and having different circumferential lengths, the following zigzag weld line 16*c* is generated on the lower surface 11*a* of the bottom portion 11 of the female snap 10*c*. That is, referring to FIG. 8, the weld line 16*c* extends from a left-right intermediate point on the through-hole 13 side almost on the virtual straight line L to go into the left half part 11L; then turns rightward toward the virtual straight line L; goes into the right half part 11R across the virtual straight line L; and then turns leftward to terminate at the radially outer end of the bottom portion 11 almost on the virtual straight line L. The weld line 16*c* enters the right half part 11R at a radial position where the left and right arc concave portions 28, 29 lies. This weld line 16*c* can also eliminate or reduce cracking of the female snap 10*c* at attaching the female snap 10*c* to the fabric 1.

DESCRIPTION OF REFERENCE NUMERALS

10, 10*a*, 10*b*, 10*c* female snap button (button)
11 bottom portion (button body)
11*a* lower surface of bottom portion (outer surface)
11*b* upper surface of bottom portion (inner surface)
12 peripheral side portion
13 through-hole
14 receiving portion
15 bulge
16, 16*a*, 16*b*, 16*c* weld line
17 gate position
21, 23 first left arc concave portion (concave portion)
22, 24 second left arc concave portion (concave portion)
25 first right arc concave portion (concave portion)
26 second right arc concave portion (concave portion)
27 concave portion
28 left arc concave portion (concave portion)
29 right arc concave portion (concave portion)
31 first right arc convex portion (convex portion)
32 second right arc convex portion (convex portion)
L virtual straight line
O center

What is claimed is:

1. An injection-molded resin button (10, 10*a*, 10*b*, 10*c*) comprising a button body (11) having a through-hole (13) at the center thereof:

wherein the button body (11) comprises a left half part (11L) and a right half part (11R), the left and right half parts (11L, 11R) being segmented left and right by a virtual straight line (L) passing through a gate position (17), on the button body (11), corresponding to a gate of a mold for molding the button (10, 10*a*, 10*b*, 10*c*) and the center (0) of the button body (11), wherein the button body (11) includes one or more concave portions (21, 22, 23, 24, 25, 26, 27, 28, 29) or one or more convex portions (31, 32) on an outer surface (11*a*) of the button body (11), the concave portions (21, 22, 23, 24, 25, 26, 27, 28, 29) or the convex portions (31, 32) being provided asymmetrically in the left and right half parts (11L, 11R), the outer surface is a surface of the button body oriented to come into contact with a fabric to which the button is attached.

2. The button according to claim 1, wherein the button body (11) includes a weld line (16, 16*a*, 16*b*, 16*c*), and wherein the weld line (16, 16*a*, 16*b*, 16*c*) appears as a nonlinear line at least on the outer surface (11*a*) of the button body (11).

3. The button according to claim 2, wherein the weld line (16, 16*a*, 16*b*, 16*c*) appears as a nonlinear line on an inner surface (11*b*) of the button body (11).

4. The button according to claim 2, wherein the weld line (16, 16*a*, 16*b*, 16*c*) appears as a nonlinear line on a peripheral surface defining the through-hole (13) of the button body (11).

5. The button according to claim 2, wherein the weld line (16, 16*a*, 16*c*) appearing on the outer surface (11*a*) of the button body (11) is at least partially zigzag.

6. The button according to claim 1, wherein the left half part (11L) and the right half part (11R) are different in volume.

7. The button according to claim 1, wherein the left half part (11L) includes one or more left arc concave portions (21, 22, 23, 24) or left arc convex portions extending or arranged in an arc shape in the circumferential direction around the center (0), wherein the right half part (11R) includes one or more right arc concave portions (25, 26) or right arc convex portions (31, 32) extending or arranged in an arc shape in the circumferential direction, and wherein the left arc concave portions (21, 22, 23, 24) or left arc convex portions and the right arc concave portions (25, 26) or right arc convex portions (31, 32) are displaced from each other in the radial direction.

8. The button according to claim 1, wherein the left half part (11L) includes one or more left arc concave portions (28) or left arc convex portions extending or arranged in an arc shape in the circumferential direction around the center (0), wherein the right half part (11R) includes one or more right arc concave portions (29) or right arc convex portions extending or arranged in an arc shape in the circumferential direction, and wherein the left arc concave portions (28) or left arc convex portions and the right arc concave portions (29) or right arc convex portions are at the same location in the radial direction and different in length in the circumferential direction.

9. The button according to claim 1, wherein the left half part (11L) or the right half part (11R) includes one or more first arc concave portions (21, 23) or first arc convex portions (31) extending or arranged in an arc shape in the circumferential direction around the center (O), and one or more second arc concave portions (22, 24) or second arc convex portions (32) extending or arranged in an arc shape in the circumferential direction, the second arc concave portions (22, 24) or second arc convex portions being provided with an interval in the radial direction relative to the first arc concave portions (21, 23) or first arc convex portions (31).

10. The button according to claim 1, wherein only one of the left half part (11L) and the right half part (11R) includes one or more concave portions (27) or convex portions on the outer surface (11*a*).

11. The button according to claim 1, wherein the button (10, 10*a*, 10*b*, 10*c*) is a female snap button (10, 10*a*, 10*b*, 10*c*), wherein the button body (11) is a bottom portion (11) of the female snap button (10, 10*a*, 10*b*, 10*c*), and wherein the female snap button (10, 10*a*, 10*b*, 10*c*) includes a peripheral side portion (12) protruding from a radially outer end of the bottom portion (11).

* * * * *